US007975747B2

(12) United States Patent
Liang et al.

(10) Patent No.: US 7,975,747 B2
(45) Date of Patent: Jul. 12, 2011

(54) ROMAN SHADE WITH HIDDEN ROPES

(75) Inventors: Wen Ying Liang, Changhua County (TW); Sheng Ying Hsu, Changhua County (TW); Wu Chung Nien, Changhua County (TW); Chien Chih Huang, Changhua County (TW)

(73) Assignee: Ching Feng Home Fashions Co., Ltd., Fuxing Shiang, Changhua County (TW)

( * ) Notice: Subject to any disclaimer, the term of this patent is extended or adjusted under 35 U.S.C. 154(b) by 200 days.

(21) Appl. No.: 12/362,424

(22) Filed: Jan. 29, 2009

(65) Prior Publication Data

US 2010/0186903 A1 Jul. 29, 2010

(51) Int. Cl.
*A47H 5/02* (2006.01)

(52) U.S. Cl. ..... 160/84.04

(58) Field of Classification Search ..... 160/84.04, 160/84.05, 84.01, 84.06, 84.03, 340, 330
See application file for complete search history.

(56) References Cited

U.S. PATENT DOCUMENTS

| | | | | | |
|---|---|---|---|---|---|
| 2,254,820 | A * | 9/1941 | Lawrence | 160/84.04 |
| 3,777,800 | A * | 12/1973 | Susoev | 160/84.04 |
| 4,934,435 | A * | 6/1990 | Regev | 160/84.04 |
| 4,974,656 | A * | 12/1990 | Judkins | 160/84.04 |
| 5,090,466 | A * | 2/1992 | Hong | 160/84.04 |
| 5,355,928 | A * | 10/1994 | Robertson | 160/84.04 |
| 5,566,735 | A * | 10/1996 | Jelic | 160/84.04 |
| 5,613,540 | A * | 3/1997 | Jelic | 160/84.04 |
| 5,649,583 | A * | 7/1997 | Hsu | 160/84.05 |
| 5,690,156 | A * | 11/1997 | Ruggles | 160/84.04 |
| 5,862,850 | A * | 1/1999 | Yang | 160/84.04 |
| 6,257,300 | B1 * | 7/2001 | Brownlie | 160/84.01 |
| 6,488,070 | B1 * | 12/2002 | Cox | 160/84.01 |
| 6,662,845 | B1 * | 12/2003 | Palmer | 160/84.01 |
| 6,817,399 | B2 * | 11/2004 | Berman et al. | 160/84.04 |
| 6,854,500 | B2 * | 2/2005 | Chen et al. | 160/84.01 |
| 6,988,526 | B2 * | 1/2006 | Judkins | 160/84.01 |
| 2004/0231802 | A1 * | 11/2004 | Hsu | 160/84.04 |

* cited by examiner

*Primary Examiner* — David Purol
(74) *Attorney, Agent, or Firm* — Egbert Law Offices PLLC

(57) ABSTRACT

A Roman shade includes a top box and a shade including a first layer and a second layer is connected to the top box. The first layer includes multiple pocket portions formed thereon and the pocket portions each are defined by folding a part upward to define a passage which extends transversely through the first layer. Multiple first holes and second holes are defined through the first layer. The pocket portion is located between the first and second holes. The second layer is located on a first side of the first layer and two control ropes each have a top end connected to the top box and a lower end of each control rope extends through the first hole from the first side of the first layer and passes over a second side of the first layer and then extends through the second hole in sequence.

3 Claims, 8 Drawing Sheets

ROMAN SHADE WITH HIDDEN ROPES

FIELD OF THE INVENTION

The present invention relates to a Roman shade with hidden ropes which extend through the first layer of the shade and can be hidden by decorating strips.

BACKGROUND OF THE INVENTION

A conventional window curtain can keep the privacy of the users in the rooms and keep out the sun light from the room. The Roman shade is used to maintain the features that the conventional curtains have and more particularly, to meet requirement of interior design. The conventional Roman shade has one end fixed to the top box and a lot of folded portions are formed on the inside and/or outside of the shade so as to establish specific decoration features. A lot of passages are defined transversely through the shade and rods extend through the passage to define sections of the shade. The shade includes multiple rings connected thereto and control ropes extend through the rings. The top ends of the control ropes are connected to the top box and the lower ends of the control ropes are fixed to the lowest rings. The user can lift and lower the shade by operation of the control ropes.

When pulling the control ropes, the sections of the shade are collected one by one by the pulling force applied to the rings. However, the control ropes are exposed from outside of the shade and make the shade look messy. Besides, children may play the control ropes and this can be dangerous when the control ropes tangle the kids.

The present invention intends to provide a Roman shade which includes multiple folded portions and two holes are defined through each of the folded portions so that the control ropes extend through the holes and are hidden by the shade.

SUMMARY OF THE INVENTION

The present invention relates to a Roman shade which comprises a top box and a shade including a first layer and a second layer is connected to the top box. The first layer has multiple pocket portions formed along a first side of the first layer. The pocket portions each are defined by folding a part upward to define a passage which extends transversely through the first layer. Multiple first holes and second holes are defined through the first layer. The pocket portions are located between the first and second holes. The second layer has a top end connected to the top box and located on the first side of the first layer. Two control ropes each have a top end connected to the top box and a lower end of each control rope is located between the first and second layers. The lower end of each of the control ropes extends through the first hole and passes over a second side of the first layer and then extends through the second hole in sequence.

The primary object of the present invention is to provide a Roman shade wherein the control ropes are hidden between the first and second layers of the shade. The hidden control ropes prevent children from playing and being tangled.

Another object of the present invention is to provide a Roman shade wherein two decoration strips are connected to the first layer to hide the control ropes so that the control ropes are not visible from either side of the Roman shade.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
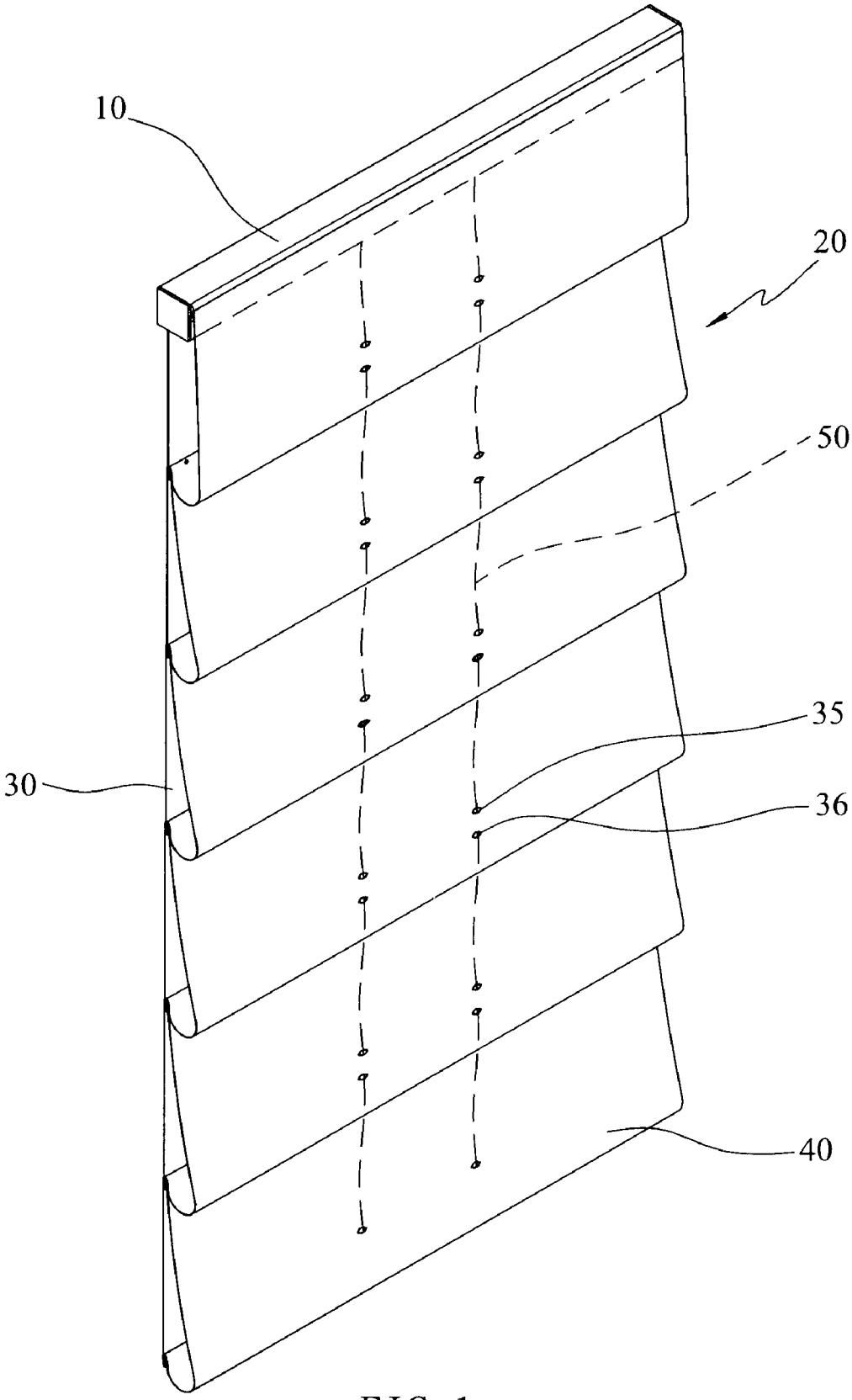
FIG. 1 is a perspective view of the Roman shade of the present invention.
Figure 2:
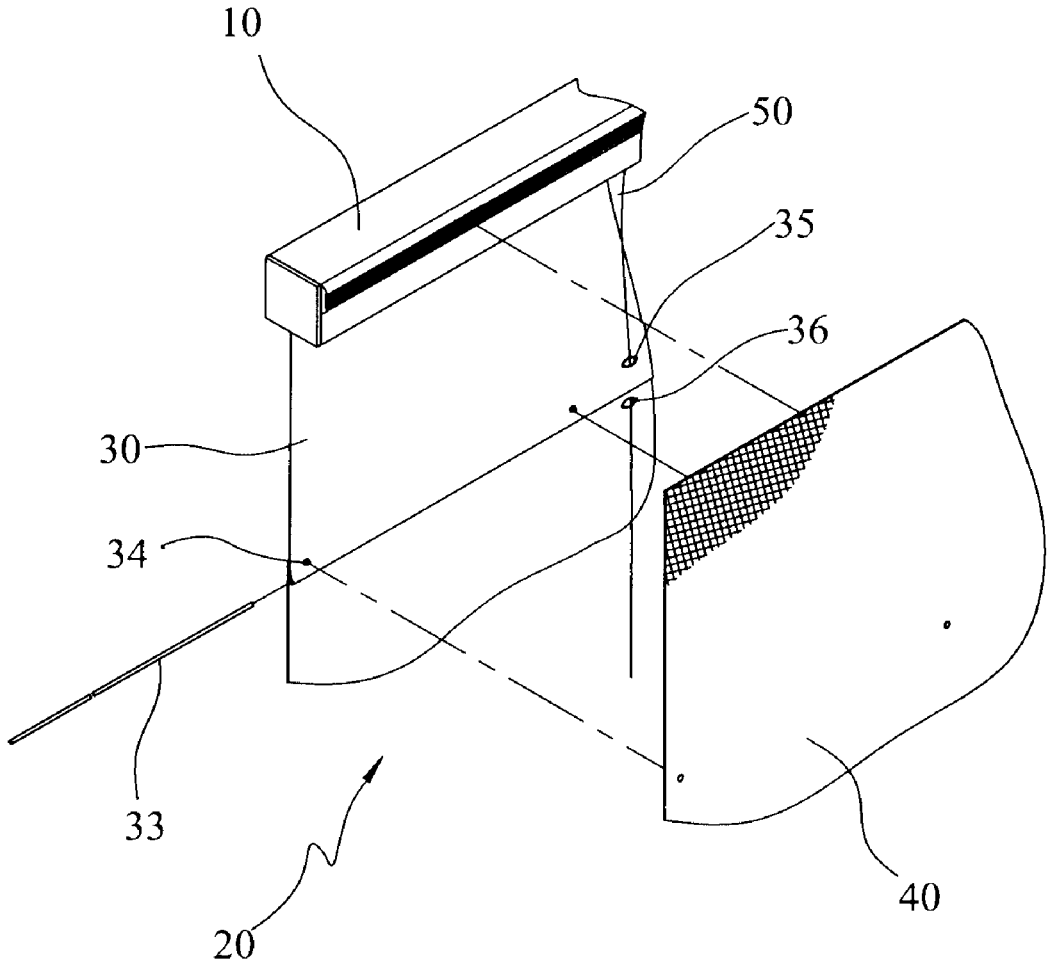
FIG. 2 is an exploded view to show a part of the Roman shade of the present invention.
Figure 3:
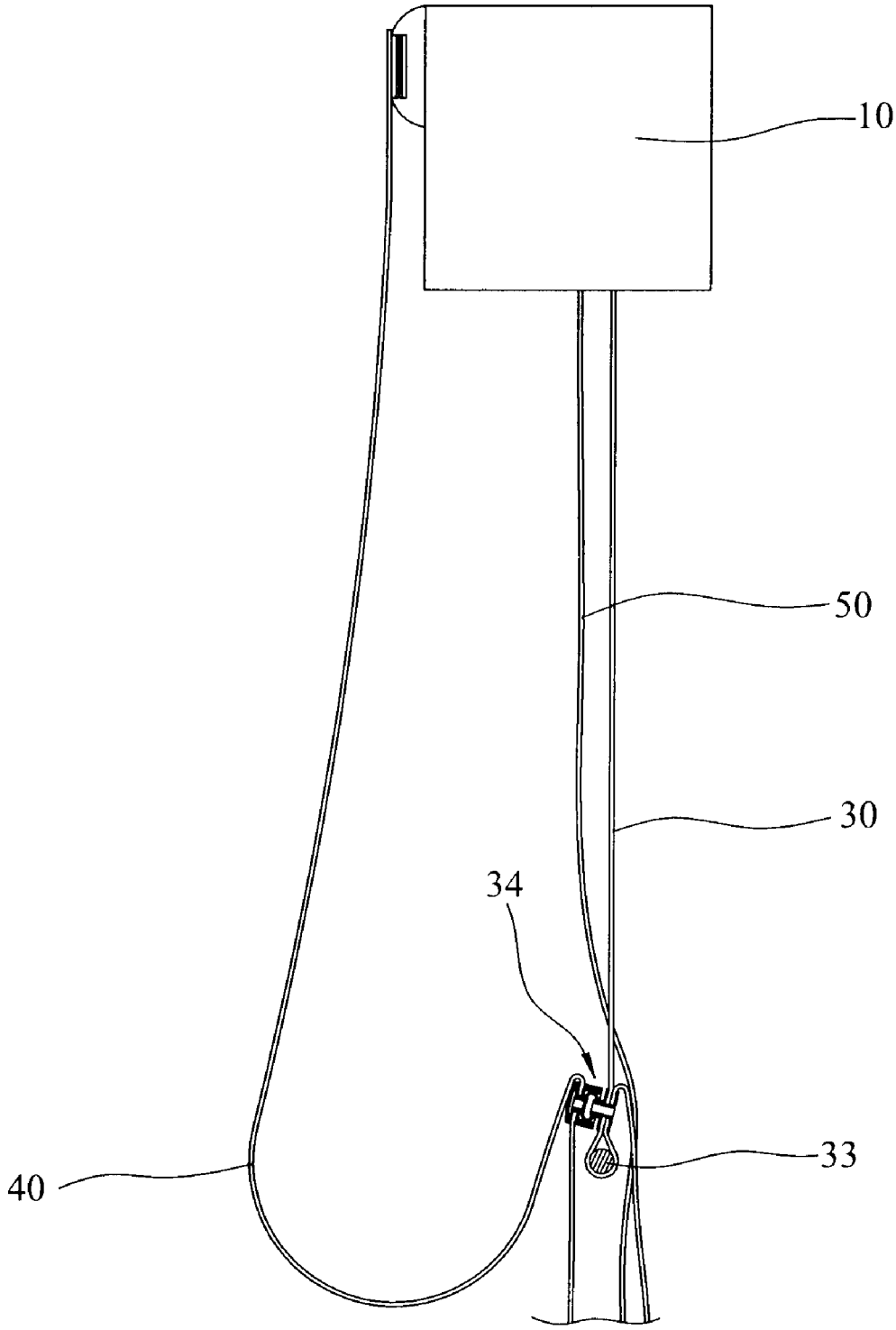
FIG. 3 is a side cross sectional view to show the Roman shade of the present invention.

Referring to FIGS. 1 to 4, the Roman shade of the present invention comprises a top box 10 in which control mechanism (not shown) is received which is known to persons in the art and will not be described in detail. A shade 20 including a first layer 30 and a second layer 40 is connected to the top box 10.

The first layer 30 faces outside of the room (not shown) and has its top end connected to the top box 10. Multiple pocket portions 32 are formed along a first side of the first layer 30 and the pocket portions 32 each are defined by folding a part upward and fixed to the first layer 30 by at least one snapping member 34. Each pocket portion 32 on the same horizontal position defines a passage 31 which extends transversely through the first layer 30. Each passage 31 has a rod 33 extending therethrough. Multiple first holes 35 and second holes 36 are defined through the first layer 30, the pocket portion 32 is located between the first and second holes 35, 36 corresponding thereto.

Figure 4:
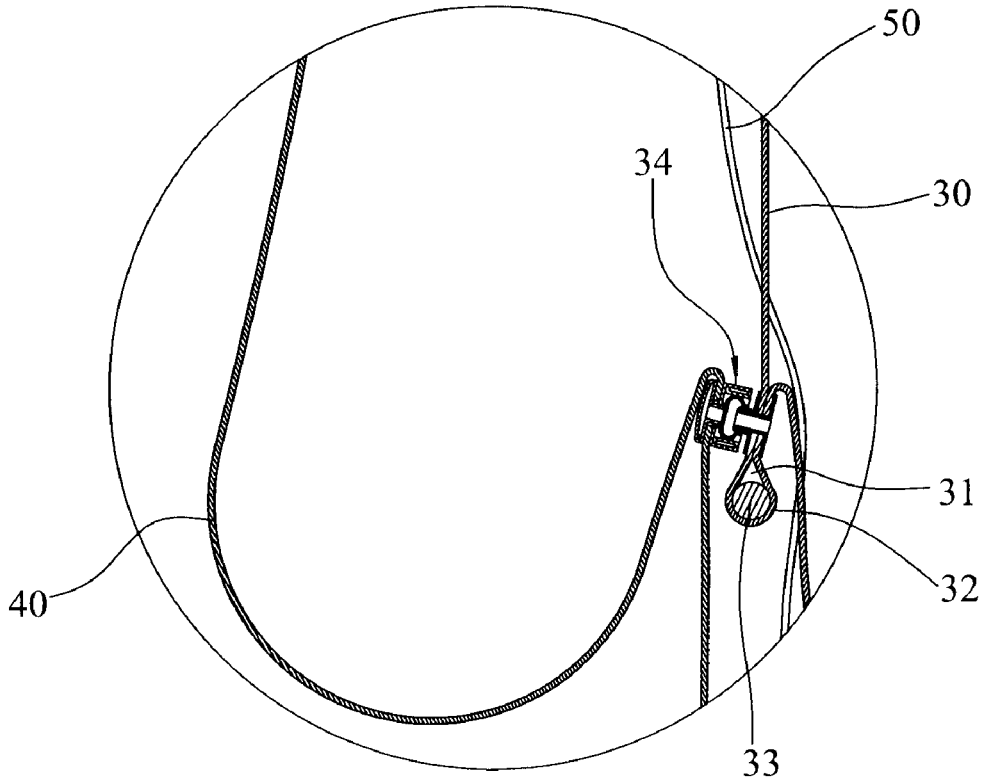
FIG. 4 is an enlarged cross sectional view to show the pocket portion and the rod extends through the passage defined by the pocket portion.
Figure 9:
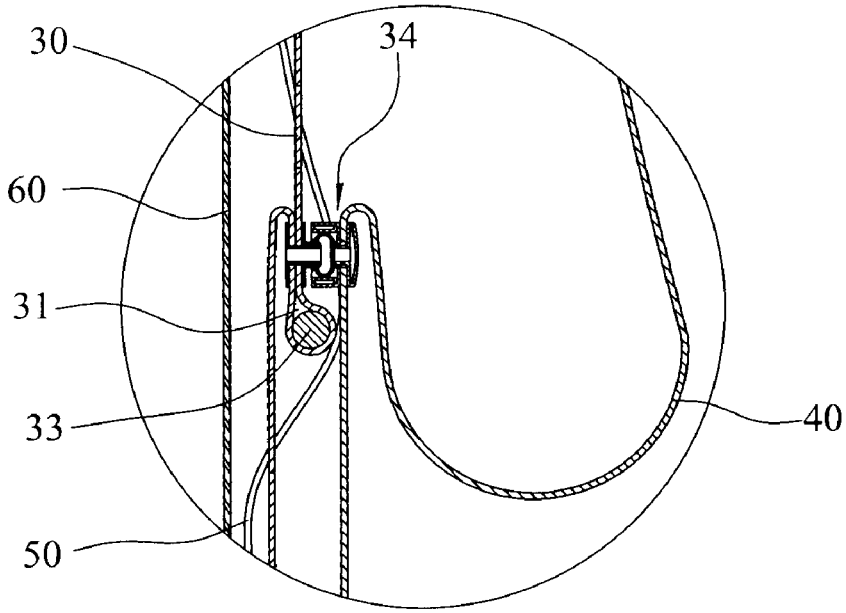
FIG. 9 is an enlarged cross sectional view to show the pocket portion and the rod extends through the passage defined by the pocket portion of the second embodiment of the Roman shade of the present invention.

The second layer 40 has a top end connected to the top box 10 and is located on the first side of the first layer 30. The second layer 40 faces the interior of the room. The second layer 40 have multiple folded portions formed thereon which are formed by folding a part inward and upward, and the part is fixed to the snapping members 34 as shown in FIG. 4.

Figure 5:
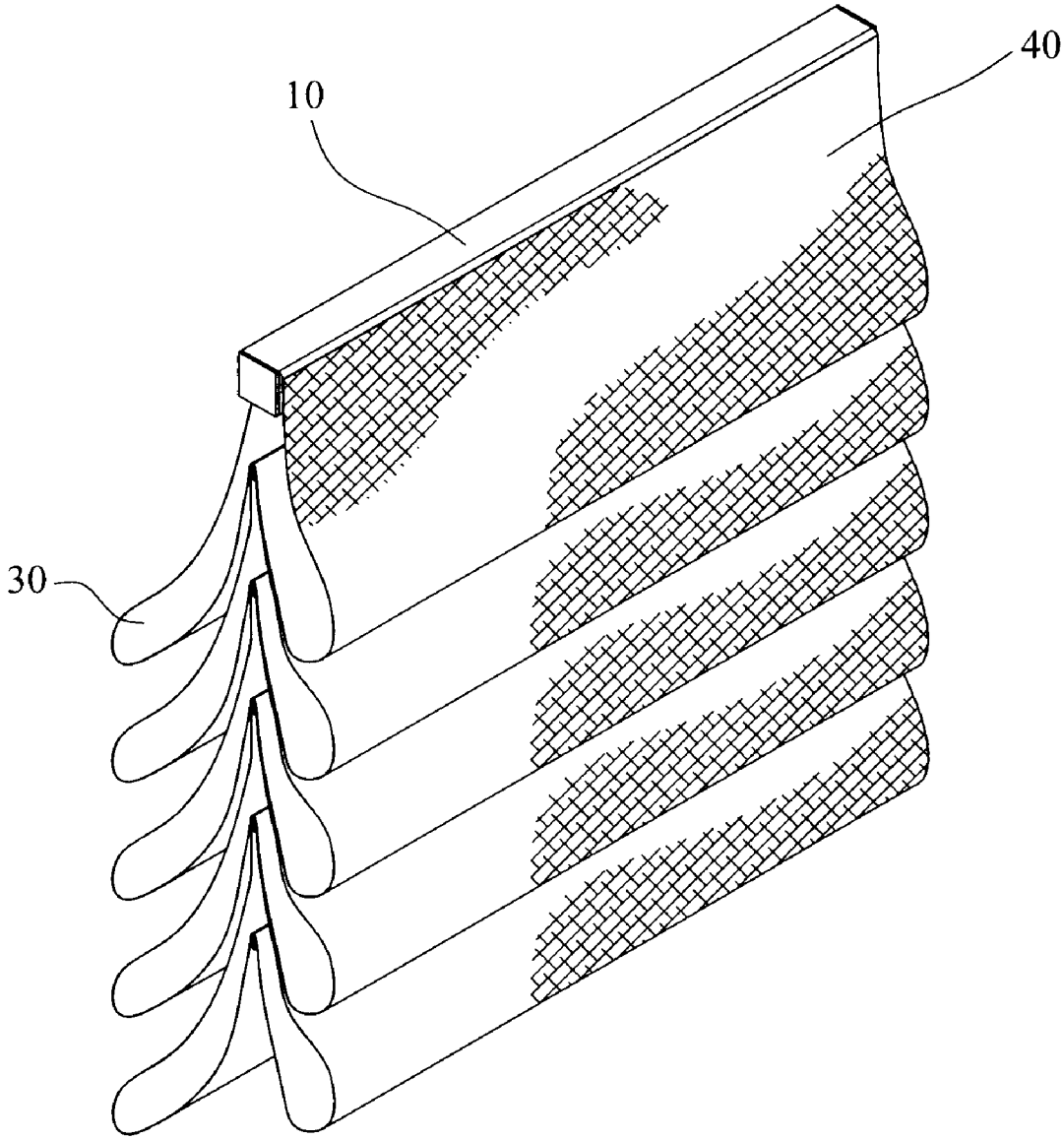
FIG. 5 is a perspective view to show that the Roman shade of the present invention is folded upward.
Figure 6:
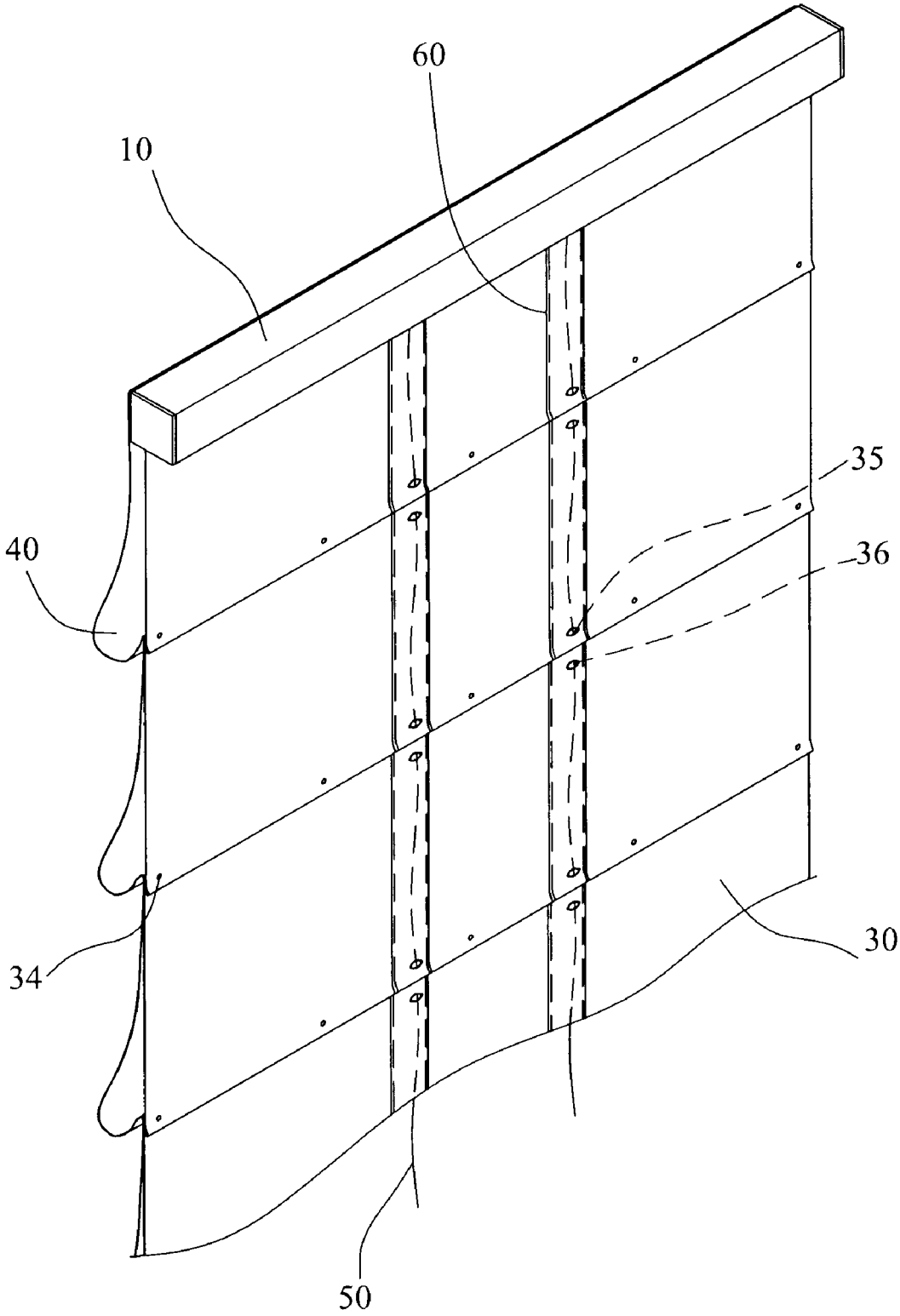
FIG. 6 is a perspective view to show another embodiment of the Roman shade of the present invention.
Figure 7:
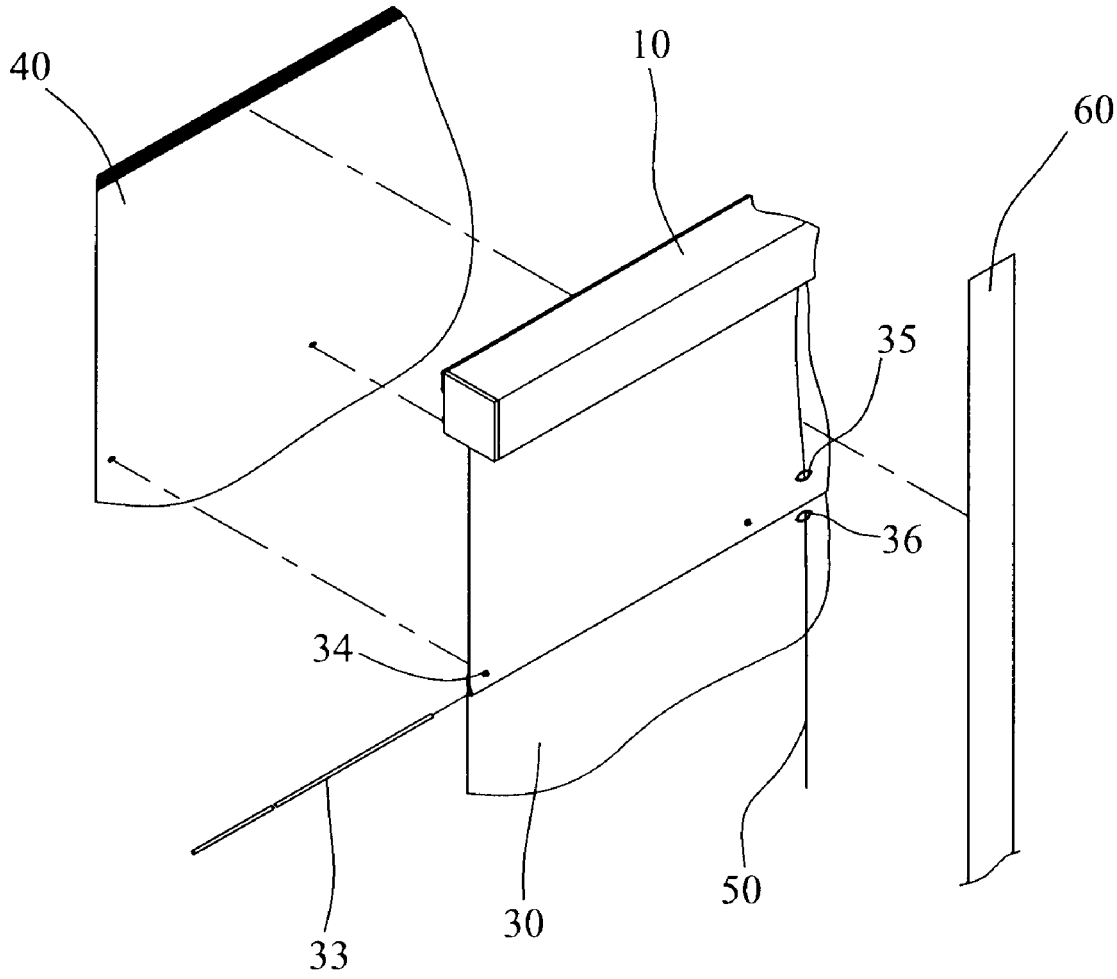
FIG. 7 is an exploded view to show the second embodiment of the Roman shade of the present invention.
Figure 8:
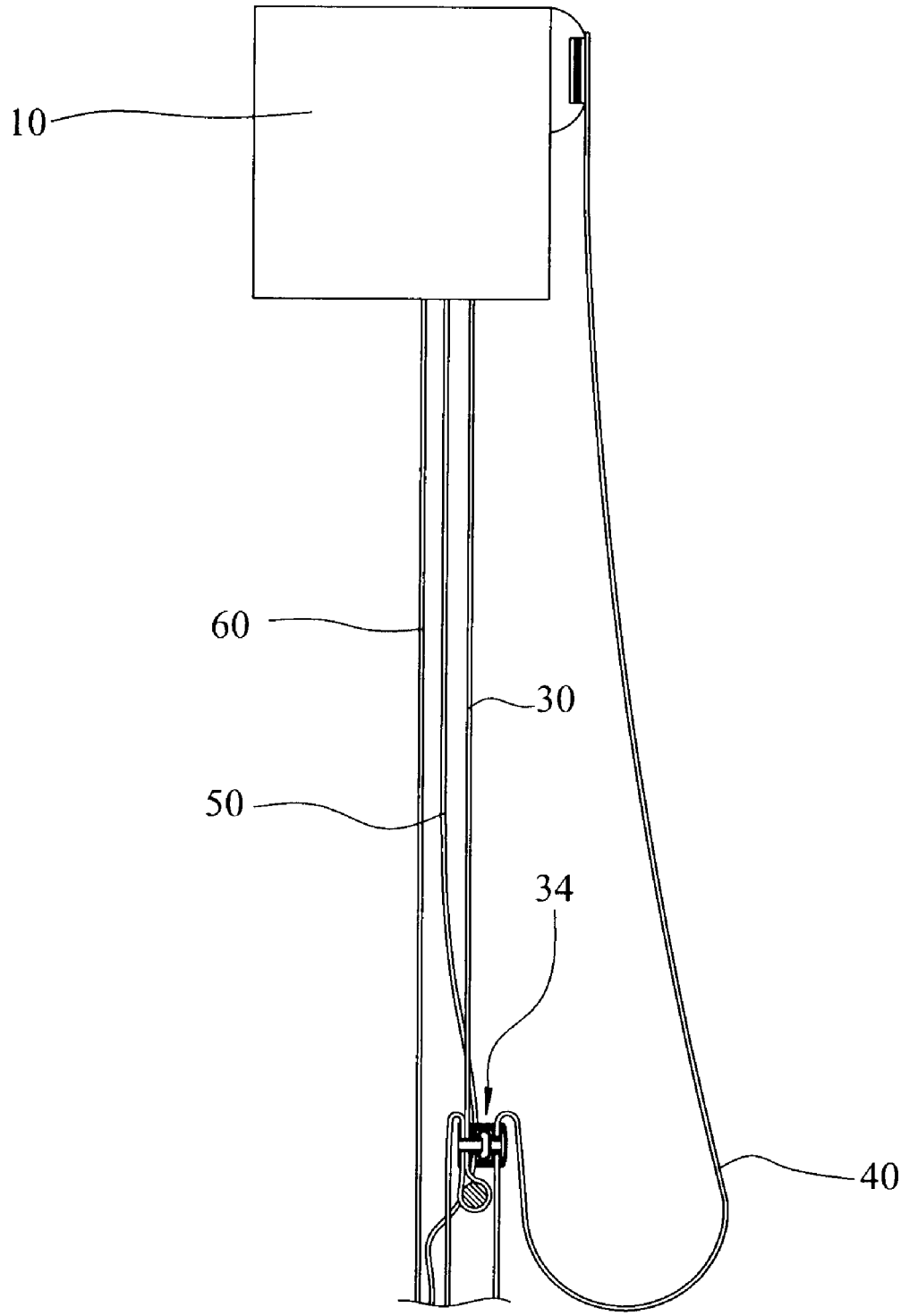
FIG. 8 is a side cross sectional view of the second embodiment of the Roman shade of the present invention.

Two control ropes 50 each have a top end connected to the control mechanism in the top box 10 and a lower end of each control rope 50 is located between the first and second layers 30, 40. The lower end of each of the control ropes 50 extends through the first hole 35 from the first side of the first layer 30 and passes over a second side of the first layer 30 and then extends through the second hole 36 in sequence. By this way, the control ropes 50 are not visible from the interior of the room and only small sections that pass over the second side of the first layer 30 can be seen from the second side of the first layer 30. The lower ends of the control ropes 50 are fixed to the lower end of the first layer 30. By operation of the control ropes 50, the first and second layers 30, 40 can be lifted as shown in FIG. 5, or lowered as shown in FIG. 1.

It is noted that the second layer 40 can be a one-piece layer or composed of multiple sections.

FIGS. 6 to 9 show the second embodiment of the Roman shade of the present invention, wherein two decoration strips 60 are connected to the second side of the first layer 30 so as to cover the control ropes 50. The decoration strips 60 hide the small sections of the control ropes 50 visible from the second side of the first layer 30 as disclosed in the first embodiment.

The Roman shade of the present invention hide the control ropes 50 so that the Roman shade has perfect outer appearance and the control ropes 50 cannot be played by children.

While we have shown and described the embodiment in accordance with the present invention, it should be clear to those skilled in the art that further embodiments may be made without departing from the scope of the present invention.

What is claimed is:

1. A Roman shade comprising:

a top box;

a shade including a first layer and a second layer, the first layer having a top end connected to the top box and multiple pocket portions formed along a first side of the first layer, the pocket portions each being defined by folding a part upward to define a passage which extends transversely through the first layer, multiple first holes and second holes defined through the first layer, the pocket portion located between the first and second holes;

the second layer having a top end connected to the top box and located on the first side of the first layer;

two control ropes each having a top end connected to the top box and a lower end of each control rope located between the first and second layers, the lower end of each of the control ropes extending through the first hole and passing over a second side of the first layer and then extending through the second hole in sequence, and two decoration strips connected to the second side of the first layer so as to cover the control ropes and hiding the control ropes visible from the second side of the first layer.

2. The Roman shade as claimed in claim 1, wherein the second layer is a one-piece layer.

3. The Roman shade as claimed in claim 1, wherein each pocket portion includes a snapping member to fix the part folded upward to the first layer.

* * * * *